US005975067A

United States Patent [19]

Strother

[11] Patent Number: 5,975,067

[45] Date of Patent: Nov. 2, 1999

[54] EFFICIENT POWER CAM FOR A COMPOUND BOW

[76] Inventor: Kevin D. Strother, 213 Ten Mile Rd, Pitkin, La. 70656

[21] Appl. No.: 09/079,044

[22] Filed: May 14, 1998

Related U.S. Application Data

[60] Provisional application No. 60/046,625, May 16, 1997.

[51] Int. Cl.[6] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 4,739,744 | 4/1988 | Nurney | 124/25.6 |
| 5,040,520 | 8/1991 | Nurney | 124/25.6 |
| 5,368,006 | 11/1994 | McPherson | 124/25.6 |
| 5,505,185 | 4/1996 | Miller | 124/25.6 |
| 5,782,229 | 7/1998 | Evans et al. | 124/25.6 |
| 5,791,322 | 8/1998 | McPherson | 124/25.6 |

*Primary Examiner*—John A. Ricci

*Attorney, Agent, or Firm*—David S. Alavi

[57] ABSTRACT

A base cam/power cam assembly for a compound bow is disclosed, the base cam/power cam assembly comprising: a) a base cam for letting out a draw cable when the assembly rotates as the bow is drawn, the base cam having an oblong shape with a major axis and a minor axis and an eccentric rotation axis substantially perpendicular to the plane of the base cam; b) a power cam for taking up a power cable when the assembly rotates as the bow is drawn, the power cam being secured to the base cam and having an oblong shape with a major axis and a minor axis and an eccentric rotation axis substantially perpendicular to the plane of the base cam and coinciding with the rotation axis of the base cam; and c) an eccentric attachment for securing the end of a let-out/take-up cable to the assembly and for letting out the let-out/take-up cable when the assembly rotates as the bow is drawn. The major axes of the base cam and power cam are angularly displaced from one another, and are arranged so that a draw cable lever arm increases and a power cable lever arm decreases when the assembly rotates as the bow is drawn. Efficiencies of at least 82% and as large as 94% are achieved.

28 Claims, 9 Drawing Sheets

123

EFFICIENT POWER CAM FOR A COMPOUND BOW

RELATED APPLICATIONS

This application claims the benefit of U.S. Provisional Application Ser. No. 60/046,625, filed May 16, 1997, said provisional application being incorporated by reference as if fully set forth herein.

FIELD OF THE INVENTION

The field of the present invention generally relates to archery bows, and in particular compound archery bows. Specifically, an efficient base cam/power cam assembly, which is mounted on a tip of a compound bow limb, and a process for the manufacture of the assembly are disclosed herein.

BACKGROUND

Solo or single-cam compound bows are well known in the art. A plurality of these have been previously disclosed, some of which are described in U.S. Pat. Nos. 5,505,185 and 5,368,006, both of which are incorporated by reference as if fully set forth herein. Dual-cam compound bows are also well known in the art, some of which are described in U.S. Pat. Nos. 4,739,744 and 5,040,520, both of which are incorporated by reference as if fully set forth herein, and in which are described in detail the mechanics of a compound bow including non-circular dual cam members which impart dynamic forces on the bow limbs.

Whether single-cam or dual-cam, the purposes and advantages of compound bows are well known to those skilled in the art and need not be repeated herein. Compound bows typically are comprised of: a handle from which resilient bow limbs extend oppositely; pulley means comprising cams, levers, and/or pulleys and typically being disposed at the tips of the limbs of the bow; and one or more cables coupled to the bow limbs and/or pulley means to give assorted mechanical advantages.

When a bow is drawn potential energy is stored in the bow limbs which are deflected substantially equally when the bow string (or draw cable) is drawn. Stored potential energy may be calculated from the draw force as a function of draw distance. Potential energy is converted to kinetic energy when the archer releases the drawn bow with the arrow placed on the draw cable, thereby allowing the bow limbs to return to their resting position and propelling the arrow. Kinetic energy may be calculated from the speed and mass of the arrow, which may in turn allow the efficiency (i.e., the fraction of potential energy converted to kinetic energy) of the bow to be calculated. It is well accepted in the industry and within the sport that efficiency is critical to bow performance: the more efficient a bow the faster the bow will propel an arrow of given weight for a given draw length and given peak draw force. Previous compound bows, single- or dual-cam, have AMO standard efficiencies of approximately 70–81% (see Table 2 on page 80 of "Bowhunting World, August, 1995, which is incorporated by reference as though fully set forth herein; see Table 2 on page 68 of "Bowhunting World" December, 1996, which is incorporated by reference as if fully set forth herein; see FIG. 3 on page 62 of "Bowhunting World" April, 1997, which is incorporated by reference as if fully set forth herein; and see Table 2, Bowhunting Buyers Guide, 1997, which is incorporated by reference as if fully set forth herein). A number of bow characteristics impact the efficiency of a bow, but many of these are well known in the art and therefore need not be repeated herein. The power cam in a single-cam compound bow (or the power cams in a dual-cam compound bow) plays a critical role in bow performance and efficiency. The power cam substantially determines the rate of and total amount of deflection of the bow limbs. There is clearly an industry need and demand for more efficient bows and specifically power cam designs which render more efficient compound bow performance. The preferred embodiment of the present invention has an AMO standard 30" draw efficiency of at least 82% and has achieved an efficiency of 94%.

Previous pulley assemblies, on either single-cam or dual-cam compound bows, typically include a base cam and a power cam module mounted to the base cam, which is rotatably mounted on the bow limb tip. Different power cam modules may be used for different draw lengths and different peak draw force. Specifically, the pulley assembly typically comprises a base cam with either one or two grooves in the perimeter portion of the base cam and one or more posts, typically on the power cam side of the base cam. As is well known in the art the posts secure the ends of the bow cable sections. A power cam module is typically mounted to the power cam side of the base cam.

Previous compound bows, single- or dual-cam, with an AMO standard 30" draw have pulley assemblies which rotate between approximately 235 and 275 degrees. The preferred embodiment of the present invention includes a power cam and base cam design which with an AMO standard 30" draw results in cam rotation of no more than approximately 210 degrees, resulting in quicker (arrow speed) and more efficient (potential energy vs. kinetic energy) bow performance. This arises from the oblong shape of the power cam disclosed herein, which is novel and unobvious for a power cam for a compound bow.

SUMMARY

Certain aspects of the present invention may overcome one or more aforementioned drawbacks of the previous art and/or advance the state-of-the-art of compound bows, and additionally may meet one or more of the following objects:

- To provide a compound bow with greater efficiency than previous compound bows;
- To provide a compound single-cam bow with greater efficiency than previous compound single-cam bows;
- To provide a compound bow with an efficiency of at least 82%;
- To provide a compound single-cam bow with an efficiency of at least 82%;
- To provide a power cam which rotates less than about 220 degrees when a 30" draw bow is fully drawn;
- To provide a power cam which rotates between about 160 degrees and about 220 degrees when the bow is fully drawn;
- To provide a pulley assembly which requires less material to machine;
- To provide a base cam which requires less material to machine;
- To provide a base cam which only needs to be machined with one jigging; and
- To provide a power cam which is integral to at least one post.

One or more of the foregoing objects may be achieved in the present invention by a base cam/power cam assembly for a compound bow, the base cam/power cam assembly comprising: a) a base cam for letting out a draw cable when the assembly rotates as the bow is drawn, the base cam having an oblong shape with a major axis and a minor axis and an eccentric rotation axis substantially perpendicular to the plane of the base cam; b) a power cam for taking up a power cable when the assembly rotates as the bow is drawn, the power cam being secured to the base cam and having an oblong shape with a major axis and a minor axis and an eccentric rotation axis substantially perpendicular to the plane of the base cam and coinciding with the rotation axis of the base cam; and c) an eccentric attachment for securing the end of a let-out/take-up cable to the assembly and for letting out the let-out/take-up cable when the assembly rotates as the bow is drawn. The major axes of the base cam and power cam are angularly displaced from one another, and are arranged so that a draw cable lever arm increases and a power cable lever arm decreases when the assembly rotates as the bow is drawn.

Additional objects and advantages of the present invention may become apparent upon referring to the preferred and alternative embodiments as illustrated in the drawings and described in the following written description and/or claims.

DETAILED DESCRIPTION OF PREFERRED AND ALTERNATIVE EMBODIMENTS

The general construction of the compound bow with which the base cam/power cam assembly of the present invention are used may be substantially the same as previous compound bows described in U.S. Pat. Nos. 5,505,185 and 5,368,006, referred to hereinabove, except for the design of the base cam/power cam assembly mounted on a bow limb tip and the cable arrangement employed thereby.

Figure 1:
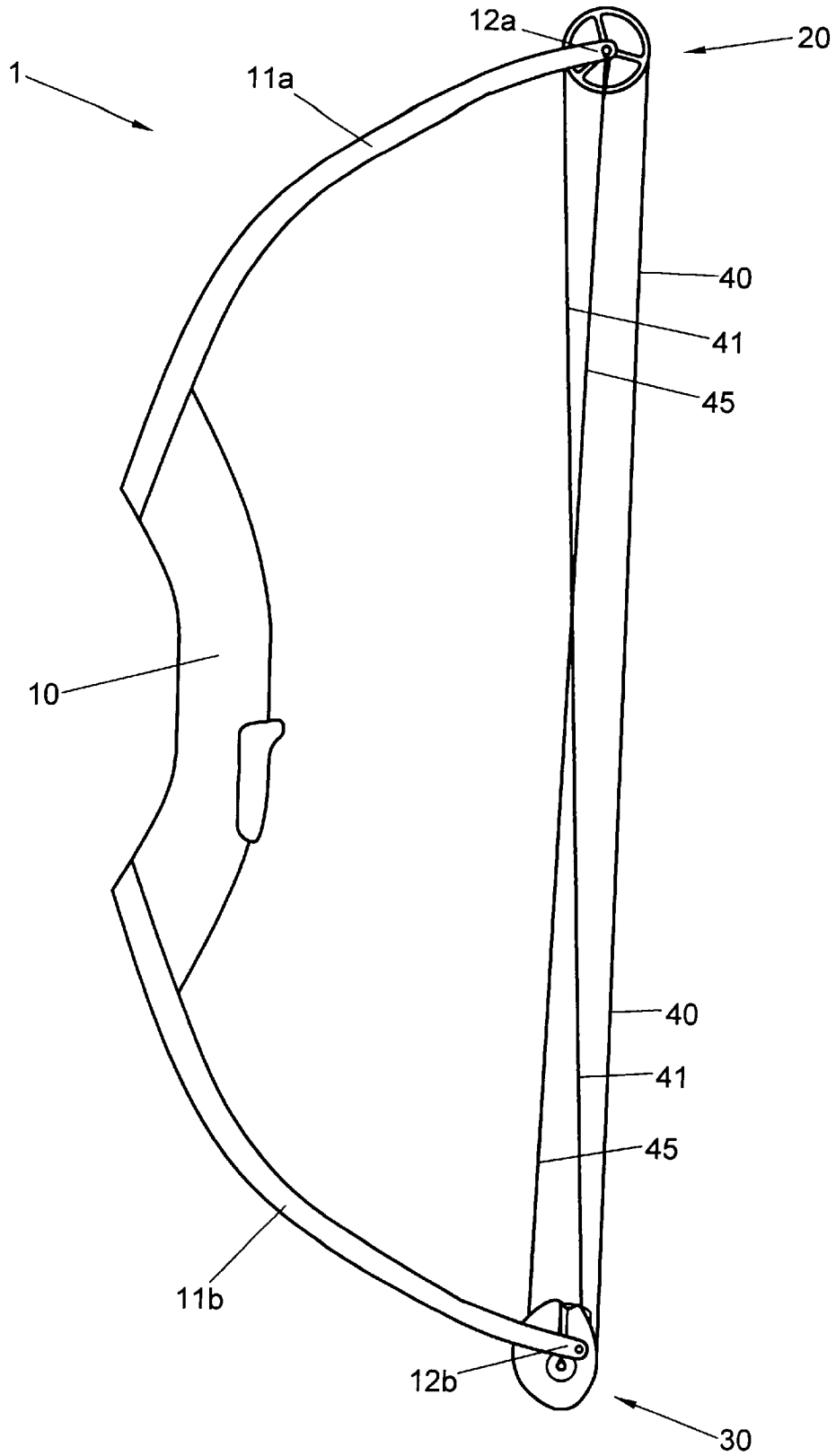
FIG. 1 is a side view showing the general features of a single-cam compound bow incorporating a preferred embodiment of the present invention.

FIG. 1 shows a compound archery bow 1, which includes a central handle portion 10. Resilient bow limbs 11*a* and 11*b* extend oppositely from the handle portion 10, including respective bow limb tips 12*a* and 12*b*, which preferably bifurcate at their ends thereby enabling the top and bottom pulley assemblies to be rotatably mounted therebetween. The specific configuration and/or arrangement of the central handle portion 10, the bow limbs 11*a* and 11*b*, and bow limb tips 12*a* and 12*b* may differ from those illustrated and described without departing from inventive concepts disclosed and/or claimed herein.

Figure 2A:
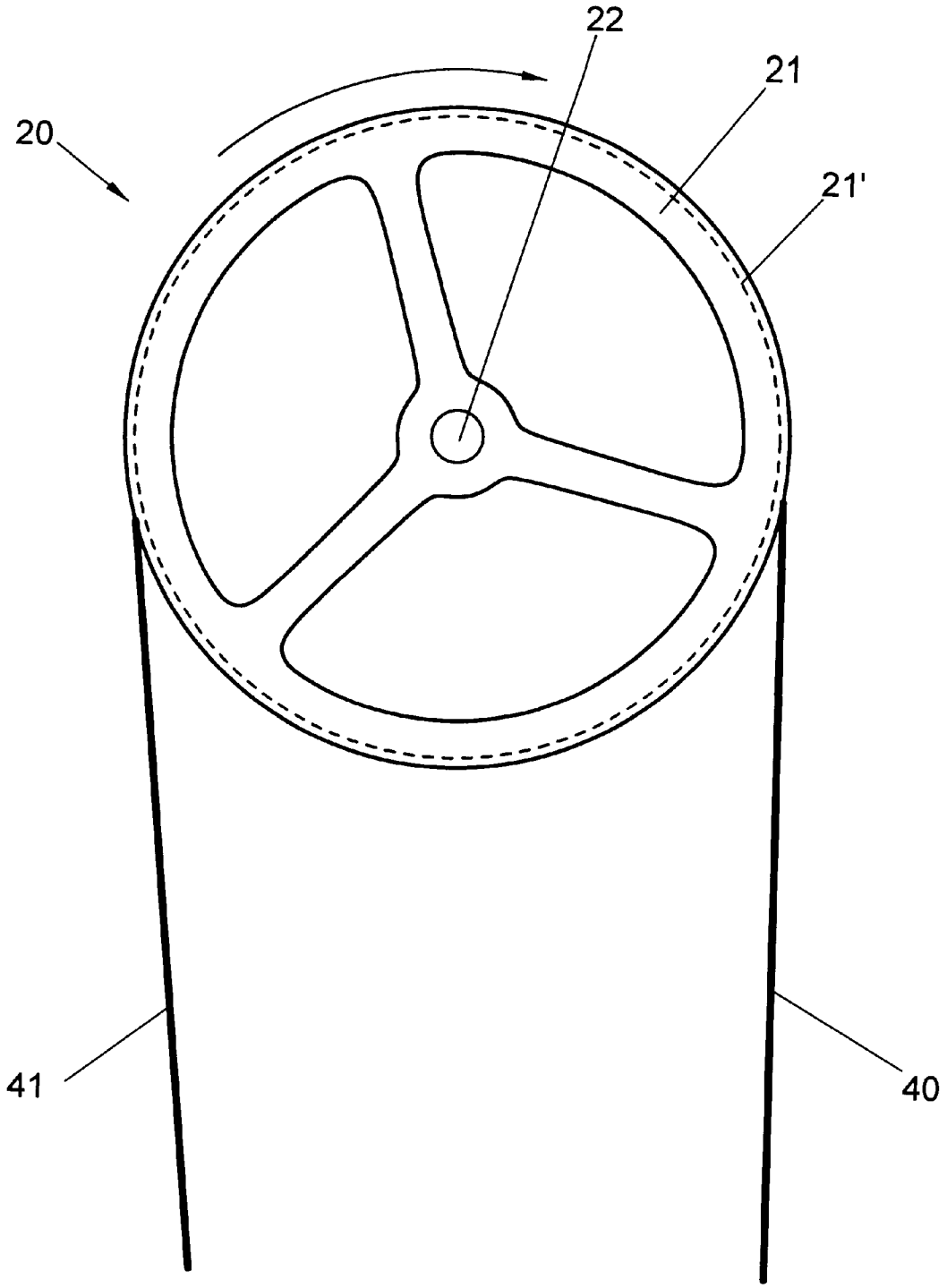
FIG. 2A is an enlarged side view of a pulley shown generally in FIG. 1, wherein the dotted line shows the pulley groove.

In a preferred embodiment of the present invention the compound bow assembly includes a top pulley assembly 20, shown in FIG. 2A, comprising a substantially circular idler wheel 21 rotatably mounted to bow limb tip 12*a* by any of a number of means well known in the art. Idler wheel 21 may include a centrally disposed bore 22 through which an axle assembly, not shown, may be employed to rotatably mount idler wheel 21 to bow limb tip 12*a*. A groove or track 21' may be provided on the periphery of idler wheel 21 in which may be received draw cable 40 and let-out/take-up cable 41. Draw cable 40 and let-out/take-up cable 41 are preferably contiguous and may pass around idler wheel 21. When draw cable 40 is drawn idler wheel 20 rotates in a clockwise direction (as shown in FIG. 2) and let-out/take-up cable 41 is taken up by wheel 21 as draw cable 40 is let out by wheel 21. The reverse occurs when draw cable 40 is released.

Figure 2B:
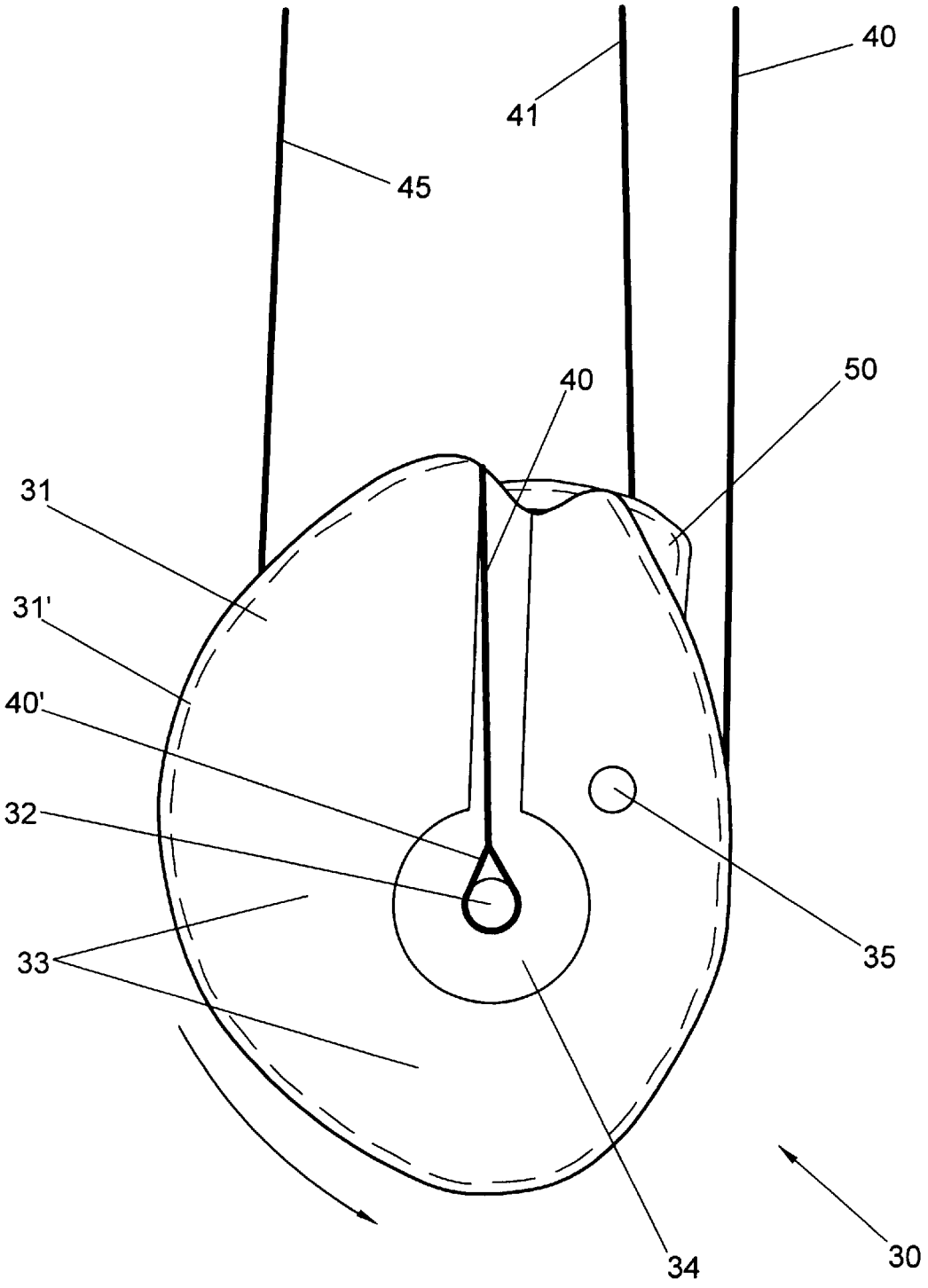
FIG. 2B is an enlarged side elevation view of the base cam side of a base cam/power cam assembly according to the present invention, shown generally in FIG. 1. The base cam/power cam assembly is shown in an undrawn, unrotated position.
Figure 2C:
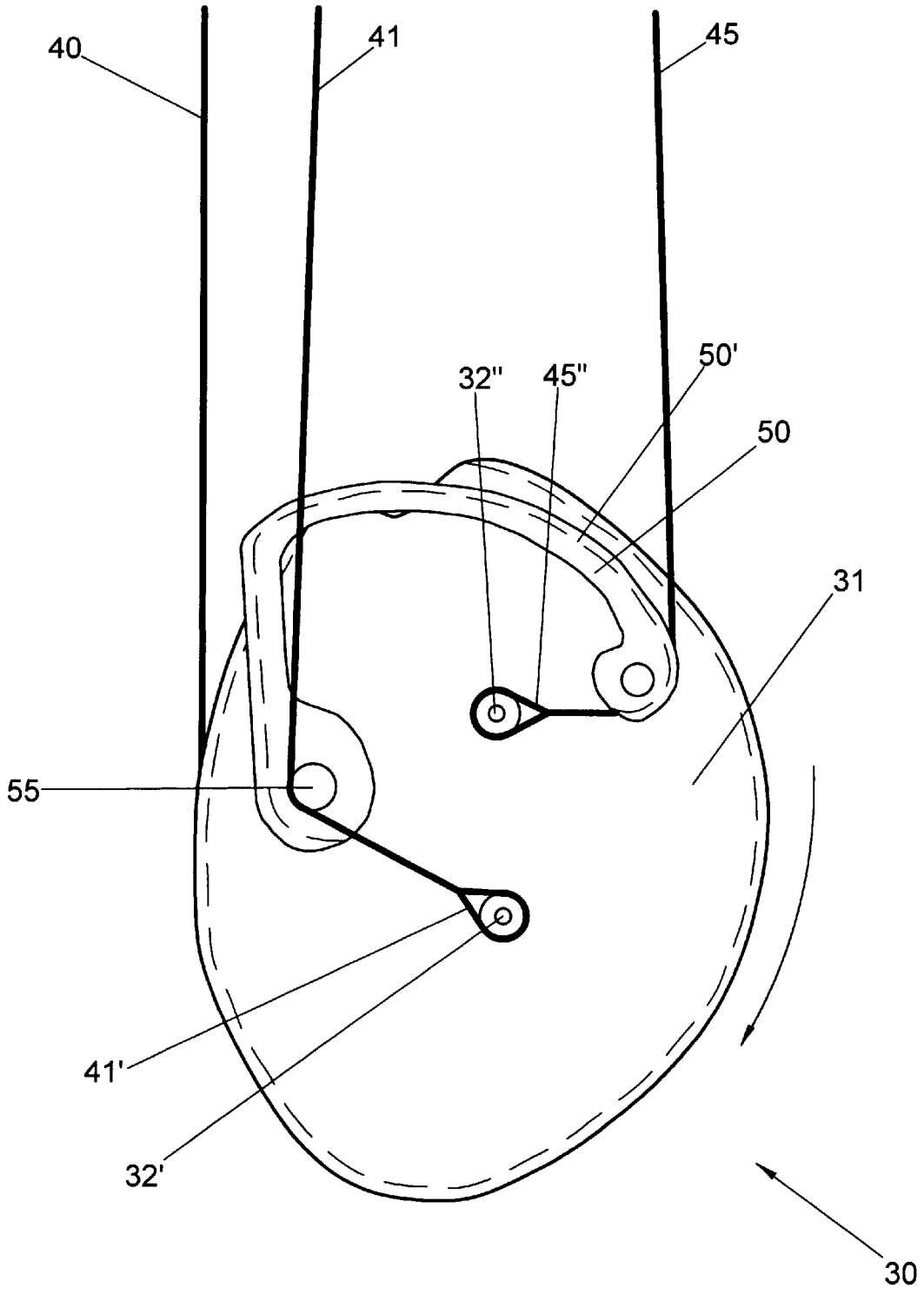
FIG. 2C is an enlarged side elevation view of the power cam side of a base cam/power cam assembly according to the present invention, shown generally in FIG. 1 (shown from the base cam side in FIG. 1). The base cam/power cam assembly is shown in an undrawn, unrotated position.

Draw cable 40 is secured at one end 40' to bottom pulley assembly 30, shown in FIGS. 2B and 2C. Let-out/take-up cable 41 is also secured at one end 41' to bottom pulley assembly 30. Bottom pulley assembly 30 (alternatively, base cam/power cam assembly 30) preferably comprises base cam 31, power cam 50, and associated mounting means and cable attachment means.

As illustrated in FIG. 2B, base cam 31 is provided with a groove or track 31' disposed on the periphery of base cam 31 in which draw cable end 40' may be received as it passes around base cam 31 and is secured to post 32, which is preferably integral to base cam 31. Post 32 preferably does not protrude from planar surface 33 of base cam 31, but resides in a cut-out or concave portion 34 of base cam 31. Without departing from inventive concepts disclosed and/or claimed herein, any functionally equivalent means may be employed to secure draw cable end 40' to base cam 31. Base cam 31 includes a preferably eccentrically disposed bore 35 through which an axle assembly, not shown, may be employed to rotatably mount base cam 31 to bow limb tip 12*b* by means well known in the art.

In a preferred embodiment of the present invention the base cam/power cam assembly 30 includes a power cam 50, shown in FIG. 2C. End 45" of power cable 45 is secured to base cam/power cam assembly 30 by post 32". Without departing from inventive concepts disclosed and/or claimed herein, any functionally equivalent means may be employed to secure power cable end 45" to base cam/power cam assembly 30. The other end of power cable 45 is preferably secured to bow limb tip 12*a*. A yoke design, well known in the art and generally shown in FIG. 1, may be employed to secure the power cable end to the axle assembly, not shown, of the top pulley assembly 20. Without departing from inventive concepts disclosed and/or claimed herein, any functionally equivalent means may be employed to secure the power cable end to bow limb tip 12*a*. Power cam 50 includes a bore 55 which coincides with bore 35 of base cam 31 through which the same axle assembly is employed.

Figure 3A:
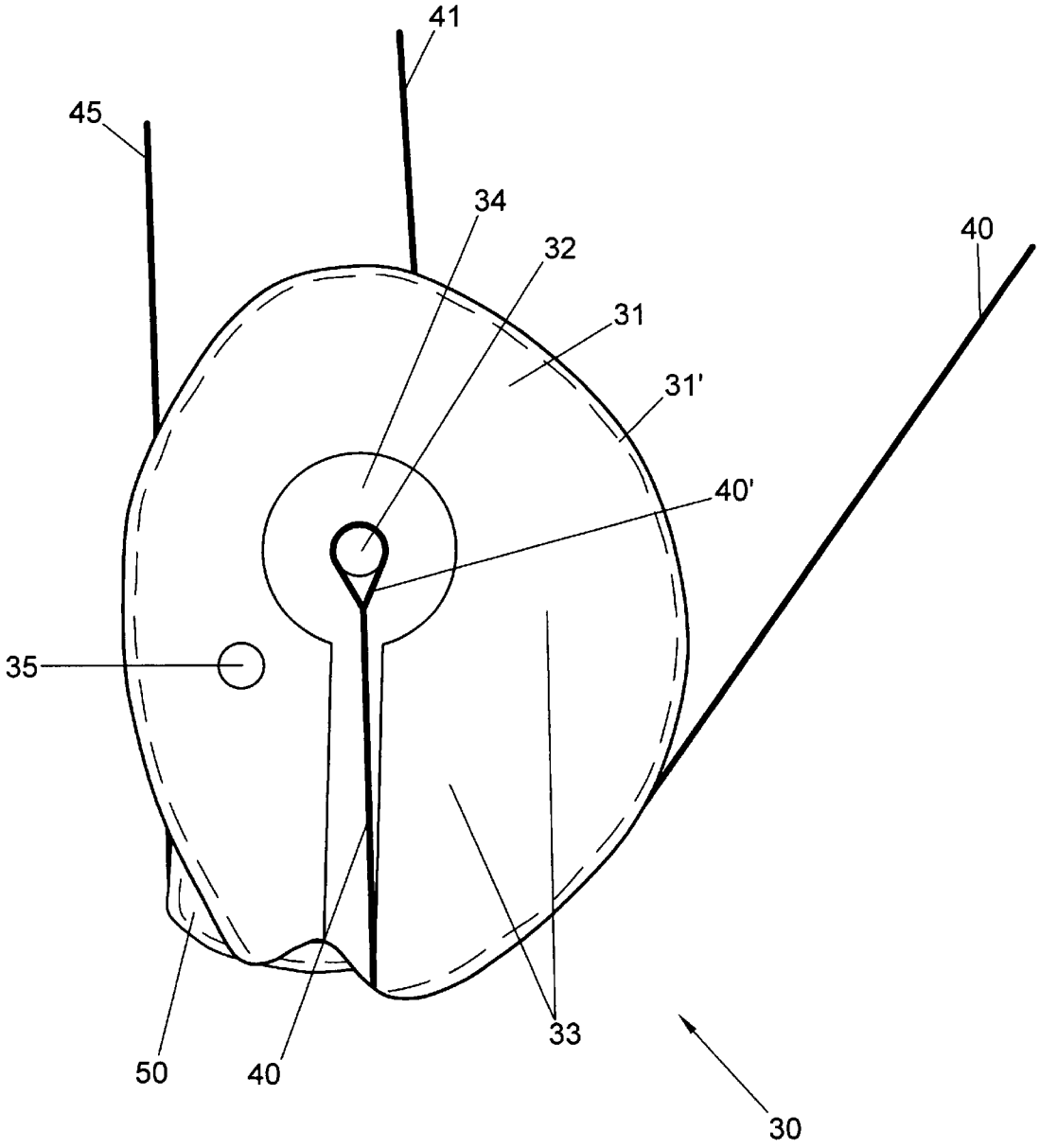
FIG. 3A is an enlarged side elevation view of the base cam side of a base cam/power cam assembly according to the present invention, shown generally in FIG. 1. The base cam/power cam assembly is shown in a drawn, rotated position.
Figure 3B:
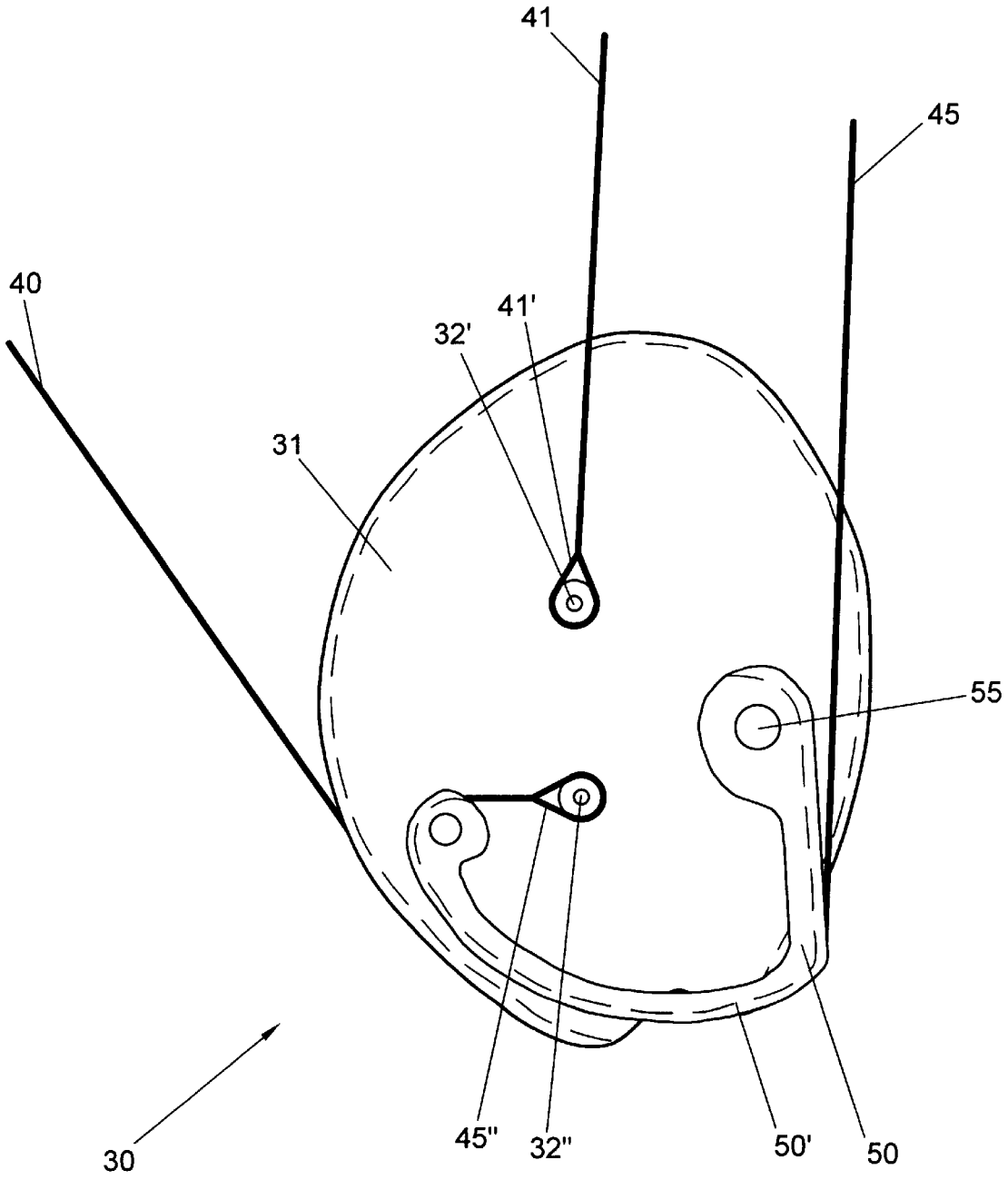
FIG. 3B is an enlarged side elevation view of the power cam side of a base cam/power cam assembly according to the present invention, shown generally in FIG. 1 (shown from the base cam side in FIG. 1). The base cam/power cam assembly is shown in a drawn, rotated position.

When the archer/user pulls the draw cable 40, preferably at a nock point substantially centrally located on draw cable 40, base cam/power cam assembly 30 rotates in a counter-clockwise direction (as viewed in FIG. 2B), thereby rolling power cable 45 into a peripheral groove or track 50' of power cam 50, thereby deflecting the bow limb tips 12*a* and 12*b* toward each other and storing potential energy in the bow. Let-out/take-up cable 41, which is secured at end 41' to post 32', is let-out during the counter-clockwise rotation of bottom pulley assembly 30 (as viewed in FIG. 2B; clockwise as viewed in FIG. 2C). It should be particularly noted that let-out/take-up cable 41 does not lie in a groove of a cam (as in previous compound bows), but rather simply wraps around axle 55 and is secured to post 32' as shown in FIG. 2C. This unique arrangement results in a let-out rate for let-out/take-up cable 41 significantly different from the let-out rates of previous compound bows. As draw cable 40 is drawn, there is little or no let-out of let-out/take-up cable 41 until post 32' passes below axle 55, at which point let-out/take-up cable 41 loses contact with axle 55. After this point, as draw cable 40 is further drawn, the rate of let-out of cable 41 is determined by the rate of rotation of the base cam/power cam assembly and the distance between post 32' and the axle in bore 55. FIGS. 3A and 3B show base cam/power cam assembly 30 rotated about 180 degrees, approximately corresponding to full draw of the bow.

Figure 4A:
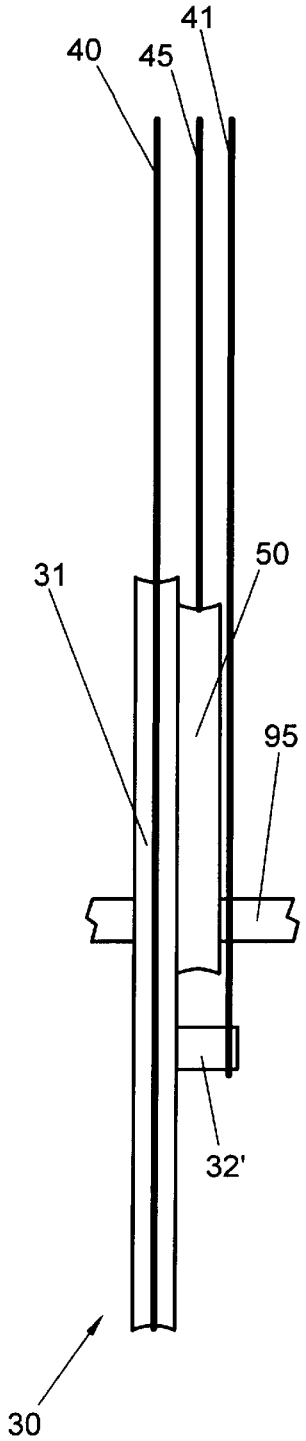
FIG. 4A is an enlarged rear elevation view of the power cam side of an alternative base cam/power cam assembly according to the present invention.
Figure 4B:
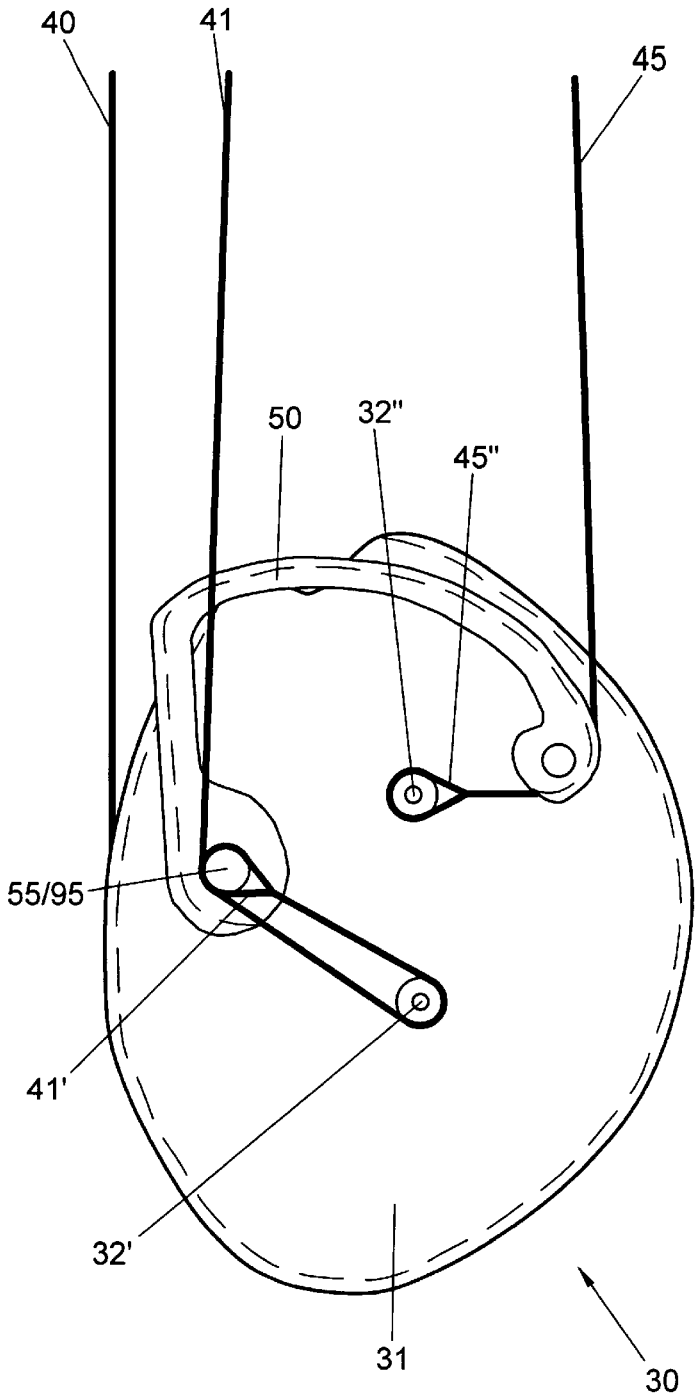
FIG. 4B is an enlarged side elevation view of an alternative base cam/power cam assembly according to the present invention.

FIGS. 4A and 4B illustrate an alternative embodiment of the present invention wherein the rate of let-out of cable 41 is dictated solely by the rate of rotation of base cam/power cam assembly 30 and the distance between post 32' and post/axle 95 substantially coaxial with bore 55. The configurations shown in FIGS. 2C, 3B, 4A, and 4B represent a significant departure from the prior art, particularly U.S. Pat. Nos. 5,368,006 and 5,505,185, cited hereinabove. In these earlier bows, the let-out/take-up cable is received in a peripheral groove of a cam, and the rate of let-out of the let-out/take-up cable is determined by the profile of the cam/groove. In the present invention, as draw cable 40 is drawn, there is little or no let-out until post 32' passes below axle 55, at which point let-out/take-up cable 41 loses contact with axle 55. After this point, as draw cable 40 is further drawn, the rate of let-out of cable 41 is determined by the rate of rotation of the base cam/power cam assembly and the distance between post 32' and the axle in bore 55. The means employed in the present invention for determining the rate of let-out of let-out/take-up cable 41 are therefore novel and unobvious in light of the current state-of-the-art of compound archery bows.

Figure 5A:
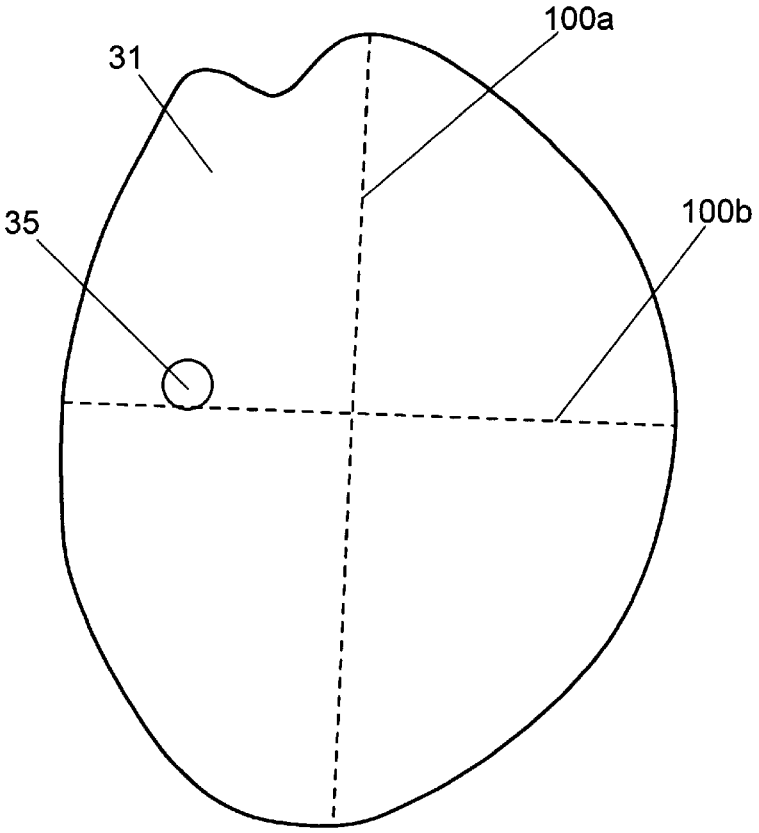
FIG. 5A is an enlarged side elevation view of the base cam shown generally in FIG. 1, wherein the major and minor axes are shown.

As illustrated in FIG. 5A, the profile of base cam 31 of base cam/power cam assembly 30, which defines the shape of groove section 31' thereof, is generally planar, non-circular, and oblong (for example, a partial oval or partial ellipse). Base cam 31 has a major axis 100*a* passing through the portion of the base cam of substantially greatest length, and a minor axis 100*b* substantially bisecting major axis 100*a* substantially perpendicularly and passing through the portion of the base cam of substantially greatest width.

Figure 5B:
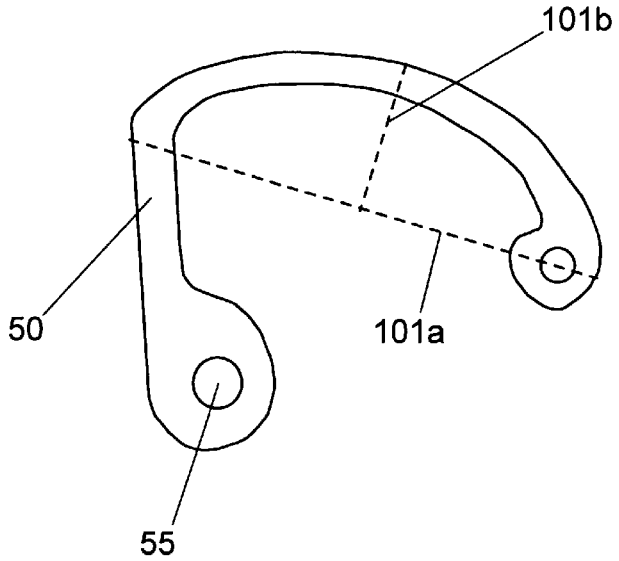
FIG. 5B is an enlarged side elevation view of the power cam shown generally in FIG. 1, wherein the major and minor axes are shown.

As illustrated in FIG. 5B, the profile of power cam 50 of base cam/power cam assembly 30, which defines the shape of groove section 50' thereof, is generally planar, non-circular, and oblong (for example, a partial oval or partial ellipse). Power cam 50 has a major axis 10la passing through the portion of the power cam of substantially greatest length, and a minor axis 101*b* substantially bisecting major axis 101*a* substantially perpendicularly and passing through the portion of the power cam of substantially greatest width.

In the most preferred embodiment of the present invention: the major axis of the base cam is approximately 3.8 inches, but may range from about 2.9 inches to about 4.3 inches; the minor axis of the base cam is approximately 3.0 inches, but may range from about 2.1 inches to about 3.3 inches; the major axis of the power cam is approximately 2.0 inches, but may range from about 1.7 inches to about 2.6 inches; and the minor axis of the power cam is approximately 0.5 inches, but may range from about 0.3 inches to 1.4 inches. The length of the minor axis of the base cam is preferably between about 70% and about 85% of the length of the major axis of the base cam. The length of the minor axis of the power cam is preferably between about 20% and about 60% of the length of the major axis of the power cam. The length of the major axis of the power cam is between about 40% and about 60% of the length of the major axis of the base cam and preferably about 53%. The length of the minor axis of the power cam is between about 40% and about 90% of the length of the minor axis of the base cam and preferably about 70%.

Although the profile of the power cam 50 is critical to the efficient performance of bow 1, utilization of the present invention also requires correlation between the groove profiles of the power cam 50, the top pulley assembly 20, and the base cam 31, among others. Correlation is necessary for: nock point travel, draw length, let-off, and maximum draw force control. The groove profiles are particularly critical because of the varying torque (with draw distance) required to maximize bow performance, by storing potential energy in a manner that maximizes kinetic energy (i.e., efficiency) and renders the bow easy to use.

Of particular import, as pointed out in U.S. Pat. No. 4,739,744 referred to hereinabove, the relationship between the power cam lever arm (hereinafter designated B) and base cam lever arm (alternatively, draw cable lever arm, hereinafter designated P) as the bow is drawn is particularly critical to bow performance. Preferably in the present invention:

| | | | | | |
|---|---|---|---|---|---|
| D = | 0 | 8 | 10 | 19 | 21.5 |
| B = | 0.39 | 1.60 | 1.85 | 2.40 | 2.25 |
| P = | 1.9 | 1.9 | 1.85 | 1.15 | 0.25 |
| B/P = | 0.21 | 0.87 | 1.00 | 2.09 | 9.00 |

The prior art includes, for example:

| | | | | | |
|---|---|---|---|---|---|
| D = | 0 | 7 | 11 | 16.5 | 21.5 |
| B = | 0.4 | 1.4 | 1.5 | 2.3 | 2.5 |
| P = | 2.5 | 2.1 | 2.0 | 1.2 | 0.35 |
| B/P = | 0.16 | 0.66 | 0.75 | 1.91 | 7.14 |

wherein:

D=draw length in inches

B=effective lever arm length of the base cam in inches

P=effective lever arm length of the power cam in inches and wherein:

the first column represents the bow at rest;

the second column represents an increasing draw force;

the third column represents at least 90% of peak draw force;

the fourth column represents the end of 90% peak draw force; and the fifth column represents the bow at full draw.

The major axis of the base cam and the major axis of the power cam are angularly displaced from one another, and preferably may be substantially perpendicular to each other. Geometric variations, however, may be made to change the orientations of the respective major axes without departing from the present invention.

The arcuate shape of power cam 50 may be described in another manner to underscore its novelty. Preferably, the base cam/power cam assembly rotates through an angle of less than about 220 degrees when the bow is drawn from its rest position to full draw. For a bow with an axle length of 35 inches and a brace height of 5 inches, this rotation angle an angle is between about 190 degrees and about 210 degrees. For a bow with an axle length of 40 inches and a brace height of 7 inches, this rotation angle an angle is between about 160 degrees and about 180 degrees. In previous compound bows the cam assembly rotates through at least 225 degrees, typically 235–275 degrees. The smaller angle of rotation of the present invention, with a power cam which reaches peak draw force quickly, results in an efficient, quick, and effective bow.

The novel and unobvious less than about 220 degree rotation of the base cam/power cam assembly 30 and the arcuate shape of power cam 50 results in AMO efficiency ratings of greater than 82% and as high as 94%. This improved efficiency relative to prior art bows may result in: greater arrow speed for a given amount of stored potential energy (i.e., draw force applied over draw length); less stored potential energy required to achieve a given arrow speed; or some combination of increased arrow speed and decreased stored potential energy. As a result, faster bows with lower peak draw force, lower holding force, and/or shorter draw length may be constructed, which would allow easier aiming of the bow and arrow when the bow is fully drawn. The improved efficiency relative to prior art bows may also be partly attributed to measured hysteresis of between about 1.4% and 3%.

Figure 6A:
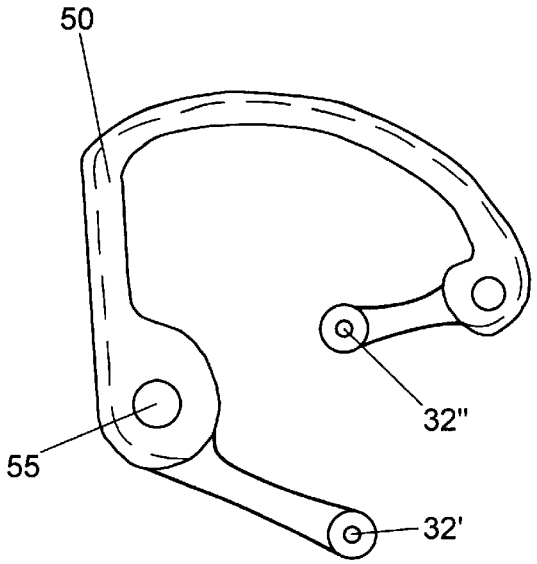
FIG. 6A is a side elevation view of a power cam according to the present invention with two posts integral thereto.
Figure 6B:
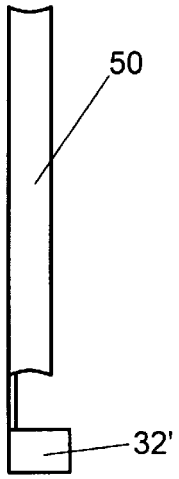
FIG. 6B is a rear elevation view of the power cam with a post integral thereto.
Figure 6C:
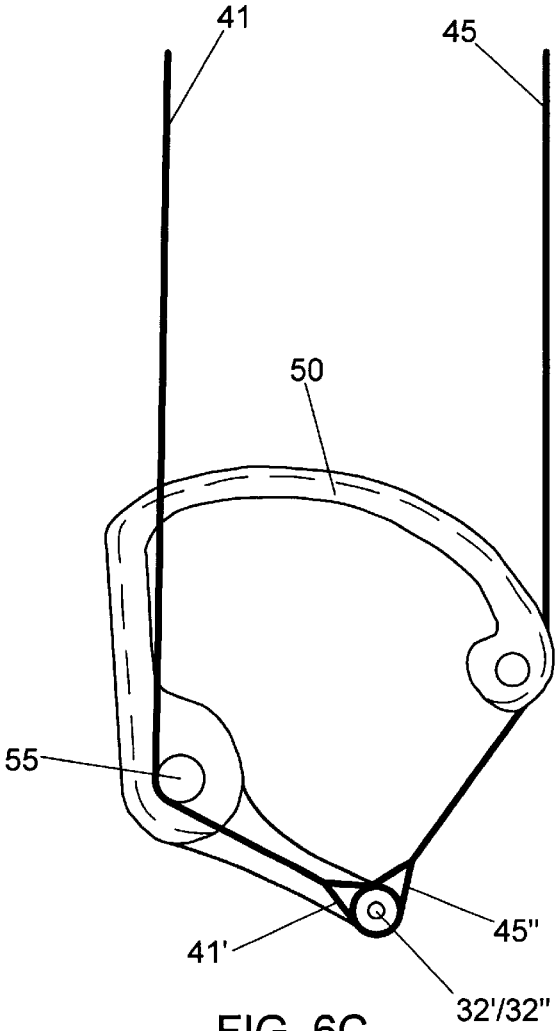
FIG. 6C is a side elevation view of a power with one post integral thereto.

To shorten the draw length of the present invention the portion of the arcuate shape of the power cam groove having the smallest radius of curvature may be changed to a greater radius (to a power cam lever arm of about 0.8 inches) without departing from the present invention. Separate power cam modules for each draw length may be provided for mounting on the base cam. If it is desired to shorten the draw length significantly, more than approximately 2.5 inches, it may also be necessary to move post 32" which secures the power cable. Therefore, different draw lengths may be accommodated by a single base cam having multiple mounting positions for post 32" as well as different power cam modules. Alternatively, as shown in FIGS. 6A, 6B, and 6C, integral power cam/post modules may be provided having the appropriate shape, dimensions, and relative positions of the power cam groove and power cable post 32" for each desired draw length.

It is widely accepted in the art that nock point travel, which is a term well known in the art, should be minimized as the bow is drawn. The respective shapes of the tracks 21' and 31' will substantially determine nock point travel when draw cable 40 is drawn and released during operation of bow 1. Therefore, the respective shapes of tracks 21' and 31' may differ from those described and illustrated herein without departing inventive concepts disclosed and/or claimed herein. In addition, the position of post 32' on base cam 31 determines the rate of let-out of let-out/take-up cable 41, which is another determinant of nock point travel. Accordingly, base cam 31 may be provided with multiple mounting positions for post 32', allowing adjustment of the rate of let-out of cable 41 and optimization of the nock point travel. Alternatively, as shown in FIGS. 6A, 6B, and 6C, integral power cam/post modules may be provided having the appropriate shape, dimensions, and relative positions of the power cam groove and let-out/take-up cable post 32' for each desired draw length. Posts 32' and 32" may also be the same post, as shown in FIG. 6C.

Such integral power cam/post modules as described above may preferably include a base plate of about 0.05" thickness which would be integral to and machined from the same block of material from which the power cam is machined. This is significantly advantageous because there is an economy of materials and machining. Overall material costs are lower because the thickness of the block piece of alloy (or other material with the desired physical properties) from which the base cam is machined does not have to be as thick, since no posts are mounted directly to the base cam. Previous base cams were/are machined from approximately ⅜" or ½" thick blocks for respectively, one or two perimeter grooves, whereas the present innovative process and apparatus may only require a base cam block of approximately 3⁄16" or ¼" thickness, respectively, for one or two perimeter grooves. The power cam in both cases may be machined from a block of approximately 3⁄16" or ¼". The elimination of at least one post on the power cam side of the base cam, and the corresponding inclusion of at least one post to the power cam, results in the need for less material to machine the base cam while the amount of material, and specifically the thickness of the block, necessary to machine the power cam remains substantially the same. The power cam with at least one post may be secured to the base cam in any of a number or means well known in the art. Preferably, the power cam with at least one integral post will be secured to the base cam at at least one end of the power cam and at at least one post.

Machining costs are lower because only one side of the base cam need be machined, whereas previous pulley assemblies included a base cam which was/is machined on both sides of the base cam. The machining of the base cam will consequently require one less jigging, or setting of the jig (which guides/tells the fabricating device how to machine the block material). The machining of the power cam will still only require one setting of the jig, and will include the machining of the at least one post in addition to the power cam.

In an alternative embodiment of the present invention, the at least one post need not be machined from the same block as the power cam 50 and therefore will not be integral to the power cam. The one or more posts may simply be secured to the base cam 31 by any means well known in the art, including simple screwing. The base cam 31 may have a simple hole while the inside of the post may be threaded so that a screw with a head having a larger diameter than the hole in the base cam 31 may be inserted into the post thereby fixing the post to the base cam. Multiple holes may be provided for mounting posts on base cam 31 to allow adjustment of draw length, nock point travel, peak draw force, etc.

The single-cam compound bow inventions discussed herein may be equally applicable to a dual-cam compound bow employing synchronization and timing techniques well known in the art.

The disclosure herein is for a right-handed bow; subtle modifications may be made for a left-handed bow without departing from the present invention.

The present invention has been set forth in the form of its preferred embodiments. It is nevertheless intended that modifications to the disclosed compound bows, base cam/power cam assemblies, and methods of manufacture may be made without departing from the inventive concepts disclosed and/or claimed herein.

What is claimed is:

1. A base cam/power cam assembly for a compound bow, the base cam/power cam assembly comprising:

a base cam for letting out a draw cable when the assembly rotates as the bow is drawn, the base cam having an oblong shape having a major axis and a minor axis, an eccentrically positioned rotation axis substantially perpendicular to the plane of the base cam, and a peripheral groove for receiving the draw cable;

a power cam for taking up a power cable when the assembly rotates as the bow is drawn, the power cam being secured to the base cam and having an oblong shape having a major axis and a minor axis, an eccentrically positioned rotation axis substantially perpendicular to the plane of the power cam and coinciding with the rotation axis of the base cam, and a peripheral groove for receiving the power cable;

a power cable attachment eccentrically positioned on the base cam for securing the end of the power cable; and a let-out/take-up cable attachment eccentrically positioned on the base cam for securing the end of a let-out/take-up cable to the assembly and for letting out the let-out/take-up cable when the assembly rotates as the bow is drawn, wherein the major axis of the base cam is angularly displaced from the major axis of the power cam, and is arranged so that a draw cable lever arm increases and a power cable lever arm decreases when the assembly rotates about the rotation axis as the bow is drawn, and wherein, before the bow is drawn, the let-out/take up cable wraps around an axle, the axle substantially coinciding with the rotation axis of the power cam and the rotation axis of the base cam.

2. A base cam/power cam assembly for a compound bow as recited in claim 1, wherein:

at an intermediate point during drawing of the bow, the let-out/take up cable loses contact with the axle; and a rate of let-out of the let-out/take-up cable as the assembly rotates after the intermediate point during drawing of the bow is substantially determined by the distance between the base cam rotation axis and the let-out/take-up cable attachment.

3. A base cam/power cam assembly for a compound bow as recited in claim 2, wherein the major axis of the base cam is substantially perpendicular to the major axis of the power cam.

4. A base cam/power cam assembly for a compound bow as recited in claim 2, wherein the power cable attachment is a power cable post and the let-out/take-up cable attachment is a let-out/take-up cable post.

5. A base cam/power cam assembly for a compound bow as recited in claim 4, wherein the power cam and at least one of the power cam post and the let-out/take-up cable post are an integral assembly.

6. A base cam/power cam assembly for a compound bow as recited in claim 4, wherein at least one of the power cam post and the let-out/take-up cable post may be mounted on the base cam in one of a plurality of mounting positions, thereby allowing adjustment of at least one of a draw length of the bow and a path of a nock point on the draw cable as the bow is drawn.

7. A base cam/power cam assembly for a compound bow as recited in claim 2, wherein: the length of the base cam major axis is between about 2.9 inches and about 4.3 inches, the length of the base cam minor axis is between about 2.1 inches and about 3.3 inches, the length of the power cam major axis is between about 1.7 inches and about 2.6 inches, and the length of the power cam minor axis is between about 0.3 inches and about 1.4 inches.

8. A base cam/power cam assembly for a compound bow as recited in claim 7, wherein: the length of the base cam minor axis is between about 2.1 inches and about 3.1 inches, and the length of the power cam major axis is between about 1.7 inches and about 2.4 inches.

9. A base cam/power cam assembly for a compound bow as recited in claim 8, wherein: the length of the base cam major axis is about 3.8 inches, the length of the base cam minor axis is about 3.0 inches, the length of the power cam major axis is about 2.0 inches, and the length of the power cam minor axis is about 0.5 inches.

10. A base cam/power cam assembly for a compound bow as recited in claim 2, wherein: the length of the base cam minor axis is between about 70% and about 85% of the length of the base cam major axis, the length of the power cam minor axis is between about 20% and about 60% of the length of the power cam major axis, the length of the power cam major axis is between about 40% and about 60% of the length of the base cam major axis, and the length of the power cam minor axis is between about 40% and about 90% of the length of the base cam minor axis.

11. A base cam/power cam assembly for a compound bow as recited in claim 10, wherein: the length of the power cam minor axis is about 70% of the length of the base cam minor axis, and the length of the power cam major axis is about 53% of the length of the base cam major axis.

12. A base cam/power cam assembly for a compound bow as recited in claim 2, wherein the rotation axis is positioned on the base cam/power cam assembly so that: the draw cable lever arm is less than about 0.8 inches before the bow is drawn and increases to greater than about 2.2 inches when the bow is fully drawn and the assembly has rotated less than about 220 degrees; the power cam lever arm is greater than about 1.9 inches before the bow is drawn and decreases to less than about 0.3 inches when the bow is fully drawn and the assembly has rotated less than about 220 degrees; and the ratio of the base cam lever arm to the power cam lever arm is less than about 0.4 before the bow is drawn and increases to greater than about 7.5 when the bow is fully drawn and the assembly has rotated less than about 220 degrees.

13. A base cam/power cam assembly for a compound bow as recited in claim 12, wherein the rotation axis is positioned on the base cam/power cam assembly so that the draw cable lever arm is less than about 0.4 inches before the bow is drawn.

14. A base cam/power cam assembly for a compound bow as recited in claim 13, wherein the rotation axis is positioned on the base cam/power cam assembly so that: the draw cable lever arm is about 0.39 inches before the bow is drawn and increases to about 2.25 inches when the bow is fully drawn and the assembly has rotated less than about 220 degrees; the power cam lever arm about 1.9 inches before the bow is drawn and decreases to about 0.25 inches when the bow is fully drawn and the assembly has rotated less than about 220 degrees; and the ratio of the base cam lever arm to the power cam lever arm is about 0.21 before the bow is drawn and increases to about 9.0 when the bow is fully drawn and the assembly has rotated less than about 220 degrees.

15. A compound bow, comprising:

a handle;

a first flexible bow limb and a second flexible bow limb, the first and second bow limbs being mounted on and projecting oppositely and substantially symmetrically from the handle and terminating in first and second bow limb tips, respectively;

a pulley assembly rotatably mounted on the first bow limb tip and comprising a substantially circular substantially concentrically mounted wheel having a peripheral groove;

a draw cable;

a power cable;

a let-out/take-up cable; and a base cam/power cam assembly rotatably mounted on the second bow limb tip and comprising a) a base cam for letting out the draw cable when the base cam/power cam assembly rotates as the bow is drawn, the base cam having an oblong shape having a major axis and a minor axis, an eccentrically positioned rotation axis substantially perpendicular to the plane of the base cam, and a peripheral groove for receiving the draw cable, b) a power cam for taking up the power cable when the base cam/power cam assembly rotates as the bow is drawn, the power cam being secured to the base cam and having an oblong shape having a major axis and a minor axis, an eccentrically positioned rotation axis substantially perpendicular to the plane of the power cam and coinciding with the rotation axis of the base cam, and a peripheral groove for receiving the power cable, c) a power cable attachment eccentrically positioned on the base cam for securing a first end of the power cable, and d) a let-out/take-up cable attachment eccentrically positioned on the base cam for securing a first end of the let-out/take-up cable to the assembly and for letting out the let-out/take-up cable when the base cam/power cam assembly rotates as the bow is drawn, wherein:

a first end of the draw cable is received within the peripheral groove of the base cam and secured to the base cam/power cam assembly;

a second end of the draw cable is received within the peripheral groove of the pulley assembly and let out by the pulley assembly as the bow is drawn;

the first end of the power cable is received within the peripheral groove of the power cam and secured to the base cam/power cam assembly;

a second end of the power cable is secured to the first bow limb tip;

the first end of the let-out/take-up cable is secured to the base cam/power cam assembly;

a second end of the let-out/take-up cable is received within the peripheral groove of the pulley assembly and taken up by the pulley assembly as the bow is drawn;

the major axis of the base cam is angularly displaced from the major axis of the power cam, and is arranged so that a draw cable lever arm increases and a power cable lever arm decreases when the base cam/power cam assembly rotates about the rotation axis as the bow is drawn; and before the bow is drawn, the let-out/take up cable wraps around an axle, the axle substantially coinciding with the rotation axis of the power cam and the rotation axis of the base cam.

16. A compound bow as recited in claim 15, wherein:

at an intermediate point during drawing of the bow, the let-out/take up cable loses contact with the axle, and a rate of let-out of the let-out/take-up cable as the assembly rotates after the intermediate point during drawing of the bow is substantially determined by the distance between the base cam rotation axis and the let-out/take-up cable attachment.

17. A compound bow as recited in claim 16, wherein the major axis of the base cam is substantially perpendicular to the major axis of the power cam.

18. A compound bow as recited in claim 16, wherein the power cable attachment is a power cable post and the let-out/take-up cable attachment is a let-out/take-up cable post.

19. A compound bow as recited in claim 18, wherein the power cam and at least one of the power cam post and the let-out/take-up cable post are an integral assembly.

20. A compound bow as recited in claim 18, wherein at least one of the power cam post and the let-out/take-up cable post may be mounted on the base cam in one of a plurality of mounting positions, thereby allowing adjustment of at least one of a draw length of the bow and a path of a nock point on the draw cable as the bow is drawn.

21. A compound bow as recited in claim 16, wherein: the length of the base cam major axis is between about 2.9 inches and about 4.3 inches, the length of the base cam minor axis is between about 2.1 inches and about 3.3 inches, the length of the power cam major axis is between about 1.7 inches and about 2.6 inches, and the length of the power cam minor axis is between about 0.3 inches and about 1.4 inches.

22. A compound bow as recited in claim 21, wherein: the length of the base cam minor axis is between about 2.1 inches and about 3.1 inches, and the length of the power cam major axis is between about 1.7 inches and about 2.4 inches.

23. A compound bow as recited in claim 22, wherein: the length of the base cam major axis is about 3.8 inches, the length of the base cam minor axis is about 3.0 inches, the length of the power cam major axis is about 2.0 inches, and the length of the power cam minor axis is about 0.5 inches.

24. A compound bow as recited in claim 16, wherein: the length of the base cam minor axis is between about 70% and about 85% of the length of the base cam major axis, the length of the power cam minor axis is between about 20% and about 60% of the length of the power cam major axis, the length of the power cam major axis is between about 40% and about 60% of the length of the base cam major axis, and the length of the power cam minor axis is between about 40% and about 90% of the length of the base cam minor axis.

25. A compound bow as recited in claim 24, wherein: the length of the power cam minor axis is about 70% of the length of the base cam minor axis, and the length of the power cam major axis is about 53% of the length of the base cam major axis.

26. A compound bow as recited in claim 16, wherein the rotation axis is positioned on the base cam/power cam assembly so that: the draw cable lever arm is less than about 0.8 inches before the bow is drawn and increases to greater than about 2.2 inches when the bow is fully drawn and the assembly has rotated less than about 220 degrees; the power cam lever arm is greater than about 1.9 inches before the bow is drawn and decreases to less than about 0.3 inches when the bow is fully drawn and the assembly has rotated less than about 220 degrees; and the ratio of the base cam lever arm to the power cam lever arm is less than about 0.4 before the bow is drawn and increases to greater than about 7.5 when the bow is fully drawn and the assembly has rotated less than about 220 degrees.

27. A compound bow as recited in claim 26, wherein the rotation axis is positioned on the base cam/power cam assembly so that the draw cable lever arm is less than about 0.4 inches before the bow is drawn.

28. A compound bow as recited in claim 27, wherein the rotation axis is positioned on the base cam/power cam assembly so that: the draw cable lever arm is about 0.39 inches before the bow is drawn and increases to about 2.25 inches when the bow is fully drawn and the assembly has rotated less than about 220 degrees; the power cam lever arm about 1.9 inches before the bow is drawn and decreases to about 0.25 inches when the bow is fully drawn and the assembly has rotated less than about 220 degrees; and the ratio of the base cam lever arm to the power cam lever arm is about 0.21 before the bow is drawn and increases to about 9.0 when the bow is fully drawn and the assembly has rotated less than about 220 degrees.

* * * * *